US006460865B2

(12) United States Patent
Keller et al.

(10) Patent No.: US 6,460,865 B2
(45) **Date of Patent: *Oct. 8, 2002**

(54) SNOWBOARD BINDING WITH CONICAL ADAPTER

(75) Inventors: Alexander Keller, Unterammergau; Edwin Lehner, Farchant; Premek Stepanek, Hohenpeissenberg, all of (DE); Piero G. Ruffinengo, Salt Lake City, UT (US)

(73) Assignee: Marker Deutschland GmbH, Eschenlohe (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/847,246

(22) Filed: May 2, 2001

(65) Prior Publication Data

US 2001/0028153 A1 Oct. 11, 2001

Related U.S. Application Data

(63) Continuation of application No. 09/166,051, filed on Oct. 5, 1998, now Pat. No. 6,227,552.

(30) Foreign Application Priority Data

Oct. 6, 1997 (DE) ..... 197 43 822
Jan. 16, 1998 (DE) ..... 198 01 293

(51) Int. Cl.[7] ..... B62B 9/04
(52) U.S. Cl. ..... 280/14.21; 280/617; 280/624; 280/625; 280/607
(58) Field of Search ..... 280/14.21, 617, 280/618, 623, 624, 625, 607

(56) References Cited

U.S. PATENT DOCUMENTS

| | | | | | |
|---|---|---|---|---|---|
| 4,398,359 | A | | 8/1983 | Chalmers, II | |
| 5,085,456 | A | | 2/1992 | Horn | |
| 5,299,823 | A | | 4/1994 | Glaser | |
| 5,520,406 | A | * | 5/1996 | Anderson et al. | 280/624 |
| 5,690,351 | A | * | 11/1997 | Karol | 280/618 |
| 5,813,689 | A | * | 9/1998 | Mansure | 280/14.2 |
| 5,890,730 | A | * | 4/1999 | Anderson et al. | 280/624 |
| 5,941,555 | A | * | 8/1999 | Dodge | 280/14.2 X |
| 5,971,420 | A | * | 10/1999 | Okajima et al. | 280/14.2 X |
| 5,971,422 | A | * | 10/1999 | Anderson et al. | 280/624 |
| 6,065,767 | A | * | 5/2000 | Girotto et al. | 280/618 X |
| 6,227,552 | B1 | * | 5/2001 | Keller et al. | 280/14.2 |

FOREIGN PATENT DOCUMENTS

| | | | | |
|---|---|---|---|---|
| DE | 297 01 404 U1 | | 12/1995 | |
| DE | 94 21 380 U1 | | 5/1997 | |
| DE | 196 16 559 A1 | | 7/1997 | |
| EP | 000514837 | * | 11/1992 | 280/617 |
| EP | 0 707 873 A1 | | 10/1994 | |
| WO | WO 94/16784 | | 8/1994 | |
| WO | WO094016784 A1 | * | 8/1994 | 280/617 |
| WO | WO 97/03734 | | 2/1997 | |

* cited by examiner

*Primary Examiner*—Paul N. Dickson
*Assistant Examiner*—Toan C To
(74) *Attorney, Agent, or Firm*—D. Peter Hochberg; Katherine R. Vieyra; William H. Holt

(57) ABSTRACT

A snowboard binding that includes lock-retaining elements having sloping or conical surfaces for guiding the sole of a snow boot into a seated position. The boot sole becomes more restricted in the longitudinal and transverse directions, the further the boot is introduced into the binding. Also is disclosed a snowboard binding and a boot combination having interengaging boot-retaining members on the binding and locking parts on the boot sole.

4 Claims, 5 Drawing Sheets

SNOWBOARD BINDING WITH CONICAL ADAPTER

This is a continuation of application Ser. No. 09/166,051 filed on Oct. 5, 1998 now U.S. Pat. No. 6,227,552.

BACKGROUND OF THE INVENTION

1. Field of the Invention

The present invention relates generally to snowboard bindings, in particular, snowboard bindings including conical or sloping boot retaining elements for guiding a boot into the snowboard binding.

2. Description of the Prior Art

In a large number of snowboard bindings, the boot is inserted in the binding and secured on the snowboard by loop straps which can be undone and adjusted in length. The boot is forced into its desired position on the standing surface by the loosening and tightening of the loop straps. The adjustment is cumbersome, and could result in seating that is not centered on the standing surface.

Many bindings come in the form of step-in bindings, which automatically fix the boot to the binding when the boot is positioned correctly on the standing surface. The boot is then pressed vertically downward into the binding, so that the binding boot retaining elements lock the boot to the binding surface. A hand grip is used to actuate the boot retaining elements, so that the boot can be brought into a released position in order for it to be possible for the boot to be raised out of the binding.

In some cases, there is provided a binding/boot combination for snowboards, in which the binding side boot retaining elements and locking units interact in the positively locking manner with mating locking parts arranged on the longitudinal sides of the boot. In the locking state, the binding is essentially fixed to the mating locking parts on the boot to the snowboard.

WO Patent No. 94/16784 discloses a device having a relatively small plate part arranged on the sole of a boot in the mid-foot region. The plate is rectangular in form and it includes shorter edges extending in the longitudinal direction of the boot, which interact as mating locking parts with binding-side boot-retaining and locking units. The plate is connected fixedly to a comparatively rigid foot shell of the boot, which results in the retainment of the boot on the snowboard, despite the small anchoring base of the boot on the binding.

DE-U 94 133 356 discloses a binding/boot combination in which the binding grips the boot in the heel region, beneath the heel, by way of two lateral pivot hooks. The ends of the hooks are designed in the manner of locking noses, and engage in lateral depressions which are arranged as mating locking elements on the heel region of the boot. In the toe region or ball of the foot region of the boot sole, there is a transverse web which is pushed into a fixed hook-like securing means of the binding when the snowboarder introduces the boot into the binding. This securing means in the front region of the boot, serves for increasing the fastening base of the boot on the binding. On the other hand, when the transverse web is, pushed into the hook-like securing means, the boot is more or less forced into a position in which the locking noses of the binding-side pivot hooks can engage in the boot side depressions. As a result, this makes it easier to find the locking position in the boot in the binding.

None of the prior art devices ensure particularly centering and support against torsional forces. None of the prior art devices include guiding means that make it easy to introduce the boot into the binding, while allowing free configuration of the boot sole. Further, none of the devices aid the guidance of the boot as it advances vertically toward the standing surface, even when the plane of the sole is essentially parallel to the standing surface, and guides the boot sole into its desired position for fixing the boot sole to the binding, while restricting the boot increasingly in the longitudinal and transverse directions as the boot becomes closer to the standing surface.

SUMMARY OF THE INVENTION

In accordance with a preferred embodiment of the present invention, there is provided a snowboard binding having guide apparatus or guide means comprised of a first and second proturbance. The proturbances are conical in shape and are provided as introduction aids that can interact with concavities on the boot flanks or boot borders of a boot, in particular in the mid-foot region.

The conical protuberances, in particular in the case of step-in bindings, make it considerably easier to reach the desired fixed position of a snowboard boot when fixed in a binding. A large amount of freedom is provided for arranging binding side locking elements and boot side mating locking parts that interact with one another for fixing the boot to the binding. In particular, the locking elements and mating locking parts can be arranged at positions which are barely visible, if at all, from above as the boot is introduced into the binding.

The invention makes it possible to introduce boots with narrow soles and sole borders, which more or less cannot be seen from above. This provides the advantage that the snowboarder can walk normally in the boots without there being any risk of stumbling.

In accordance with a preferred aspect of the present invention, snowboard side protuberances, which are provided as introduction aids, can interact with concavities on the boot flanks or boot borders, particular in the mid-foot region.

In the case of a binding boot combination for snowboards, where the binding side boot retaining and locking units interact in a positively locking manner with mating locking parts on the boot, two mating locking parts which are spaced apart in the longitudinal direction of the boot and include an indent from between them are arranged on each longitudinal side of the boot. The boot retaining and locking units engage in the indents in a positively locking manner by the way of protuberances or noses having a conical shape. The protuberances make it possible to fix the mating locking parts at least vertically by the way of movable locking elements and/or mating locking parts, which are spaced apart in the longitudinal direction of the boot, or mating locking parts arranged on each longitudinal side of the boot interact in a positively locking manner on each side of the boot by way of stop-like guides. The stop-like guides ensure that the boot is fixed in the longitudinal direction and transverse directions in the process. This also makes it possible to fix the mating locking parts vertically by way of locking elements.

The guide means on the binding interact with the boot to introduce the boot into the binding. The longitudinal axis and the transverse axis of the boot are forceably guided and/or aligned in accordance with the desired locking position.

The indents and protuberances, which are provided according to the invention for this purpose, can easily be brought into their engagement position relative to one another, since the protuberances always remain easily visible from the sides of the respective boot. The mating locking parts arranged beside the indents can also be seen easily, even when the mating locking parts do not project from the sole border or the side surfaces of the boot. Slightly tilting the foot sideways in the snow boot make it possible for the position of the mating locking parts relative to the associated protuberances of the binding to be seen easily.

Furthermore, it is particularly advantageous that the stop-like guides in conjunction with the mating locking parts and/or their elements in conjunction with corresponding binding side protrusions, which may be designed as a continuation of the protuberances, can fix the boot in the locking position firmly in the longitudinal and transverse directions. The locking elements of the binding, which interact with the boot side mating locking parts, assume the task of fixing the mating locking parts and the boot in the vertical direction.

In this context, there is provided the additional advantage that, overall play free securing of the boot can be ensured since the boot retaining and locking units fix the boot at a total of four points. In a plain view of the snowboard, the corners of a quadralateral are formed extending on both sides of the longitudinal axis of the boot. Good centering of the boot in the binding is the result. The actions of the protuberances engaging in the indents and/or the mating locking parts or their elements against the guides have an additional centering effect.

According to another aspect of the preferred embodiment of the invention, the mating locking parts on the boots may be offset to the rear relative to a central region between the heel and ball of the foot, into a region which, in normal shoes or boots is occupied by the heel. It is possible for the mating locking parts to be arranged on a rigid heel-side structural part for the rest of the boot to be a very flexible design.

An object of the invention is to provide a snowboard binding that includes an introduction aid for guiding the snowboard boot into the binding as it advances vertically toward the standing surface.

A further object of the present invention is to provide a snowboard boot binding that ensures particularly good centering and support against torsional forces, while maintaining easy insertion of the snowboard boot into the binding.

Another object of the present invention is to provide a snowboard boot binding that achieves the above stated objects, with respect to a binding having locking members that engage locking parts on a boot sole, while also providing the above stated objects with a snowboard binding having locking parts for engaging the sides of a boot sole.

Another object of the invention is to provide a snowboard binding that is easy to operate.

These and other objects will become apparent from the following description of a preferred embodiment taken together with the accompanying drawings and the appended claims.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED DESCRIPTION OF PREFERRED EMBODIMENT

Figure 1:
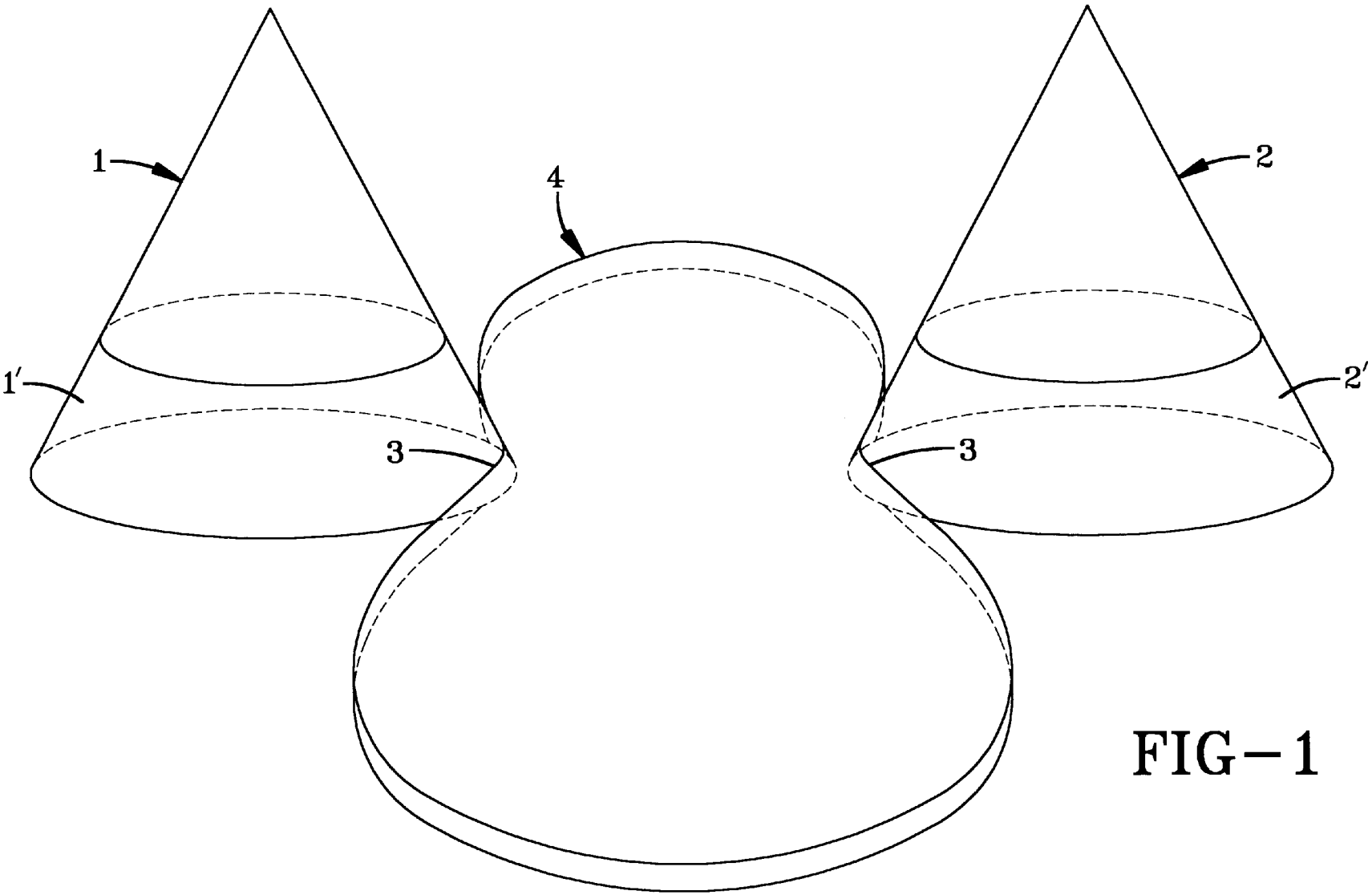
FIG. 1 is a perspective view of the advantageous design concept.

Referring now to the drawings wherein the showings are for the purpose of illustrating the preferred embodiment of the invention only, and not for the purpose of limiting same, FIG. 1 shows the preferred invention in the form of a design concept. Two protuberances 1 and 2, shown in the form of cones, are arranged on the top side of the snowboard or of a snowboard binding base plate arranged on the snowboard. Protuberances 1, 2 interact with concave indents 3 on the longitudinal borders in the mid-foot region of a sole 4 of a snowboard boot The sole 4 and boot is secured in a positively locking manner, so that the sole cannot move at all in the longitudinal and transverse directions, when the boot is positioned on the standing surface between protuberances 1 and 2. As the boot is advanced vertically toward the standing surface, the ability of the boot to move in the longitudinal and transverse directions is increasingly restricted Conical protuberances 1 and 2 are provided merely by way of example. In order to function as an introduction aid, it is essentially only the bottom mutually opposite regions 1' and 2' of the protuberances 1 and 2, which are essential. Otherwise, protuberances 1 and 2 may also be configured in a form other than that of a cone, for example it may be configured in a manner similar to a half ellipsoid.

Figure 2:
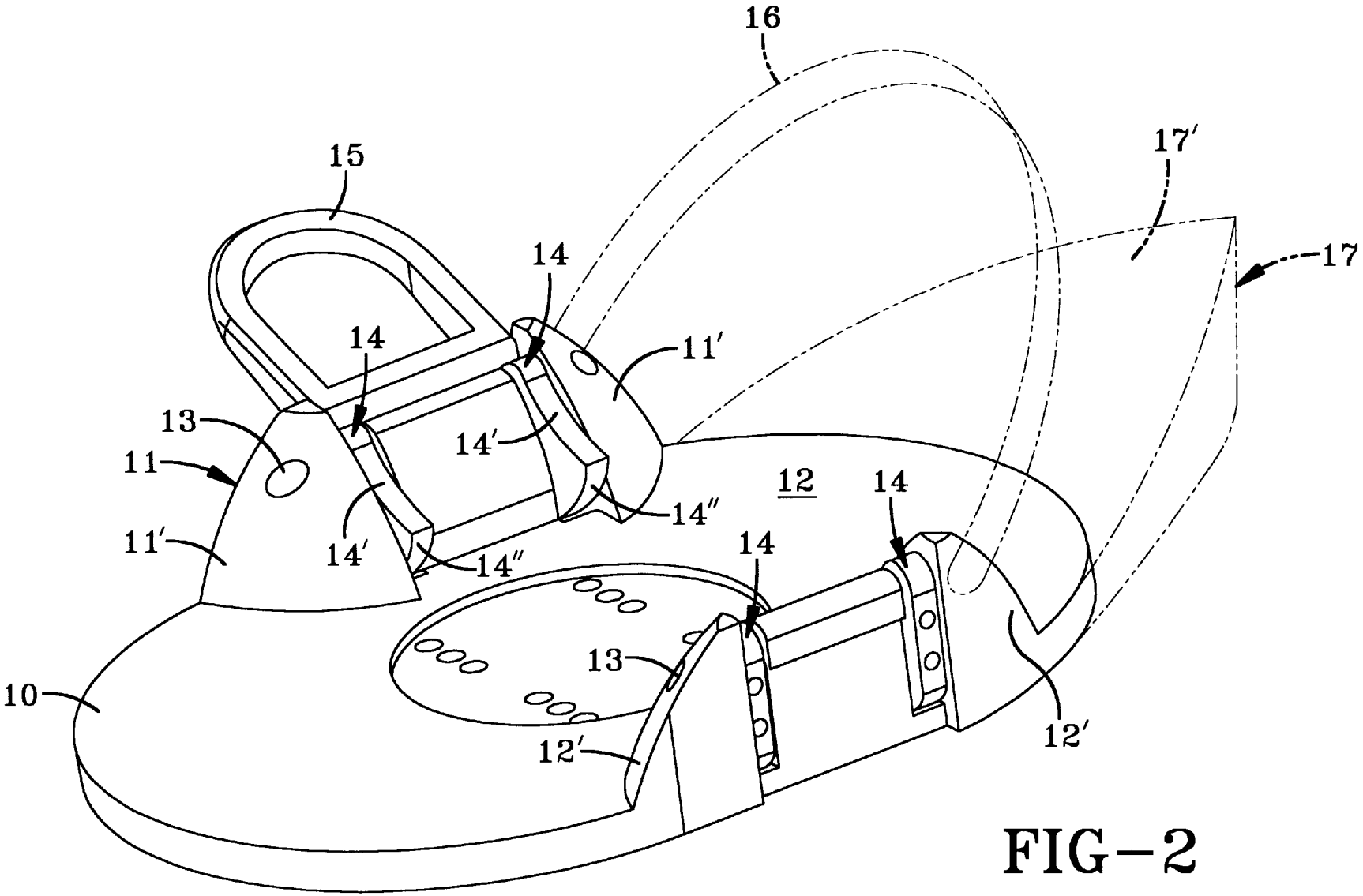
FIG. 2 is a perspective view of the snowboard binding of the design concept of FIG. 1.

Referring now to FIG. 2, a snowboard binding has a base plate 10, which can be mounted on the top side of the snowboard in different positions forming a standing surface for the boot. Protuberances 11 and 12 are arranged or integrally formed on two diametrically opposite sides of base plate 10. These protuberances essentially comprise segments 11' and 12' having outer surfaces that are oriented toward base plate 10, and form sections of part of a sphere or a part of an ellipsoid. Protuberance segments 11' and 12' interact with correspondingly adapted recesses on the longitudinal borders of the sole, when the boot is positioned on base plate 10. The sole is retained, such that it virtually cannot move at all in the longitudinal and transverse directions. Locking members 14 are arranged between segments 11' and segments 12'. Locking members 14 can each be pivoted about a pin 13 and have sliding surfaces 14' that are essentially axial with respect to pin 13, and locking surfaces 14". Locking surfaces 14" extend essentially in the circumferential direction With respect to pin 13.

Upon introduction of the boot between proturbances 11 and 12, regions of the lateral sole borders or strips arranged thereon are positioned on the sliding surfaces 14'. The boot is pressed down toward base plate 10 forcing locking members 14 back counter to the force of spring arrangements (not shown), between respective segments 11' and 12'.

As soon as the boot is positioned on base plate 10, locking members 14 are forced back into the locking position, which can be best seen in FIG. 2. Locking surfaces 14' grip over the sole border, or the boot retaining apparatus which can be strips arranged on the sole or on any other mating locking parts resulting in the boot being secured against being raised from base plate 10.

Actuation of a hand lever 15 makes it possible for at least one locking member 14 to be pivoted between adjacent segments 11', in order for it to be possible to raise the boot from base plate 10. If appropriate, locking members 14 may be positively coupled to one another by gear mechanism parts, which can be accommodated in cutouts of base plate 10 with the result that the hand lever 15 can acuate all locking members 14, simultaneously.

A loop 16 may additionally be arranged, as a positioning stop for the boot on base plate 10, or between mutually opposite parts or protuberances 11 and 12. Loop 16 may interact with the heel of the boot or the instep region of the boot in order for it to be possible for the boot, even at a relatively large distance from base plate 10, to be brought more easily into the vicinity of its subsequent desired position.

In addition, or as an alternative, to protuberances 11 and 12, ramp-like channels may be arranged on base plate 10, or on the top-side of the snowboard. The channels can interact with the heel side and/or boot toe-side sole border with each sloping down toward the toe or heel of the boot. A ramp part 17 of this type with a markedly concave ramp surface 17' is shown by dash lines in FIG. 2.

Figure 3:
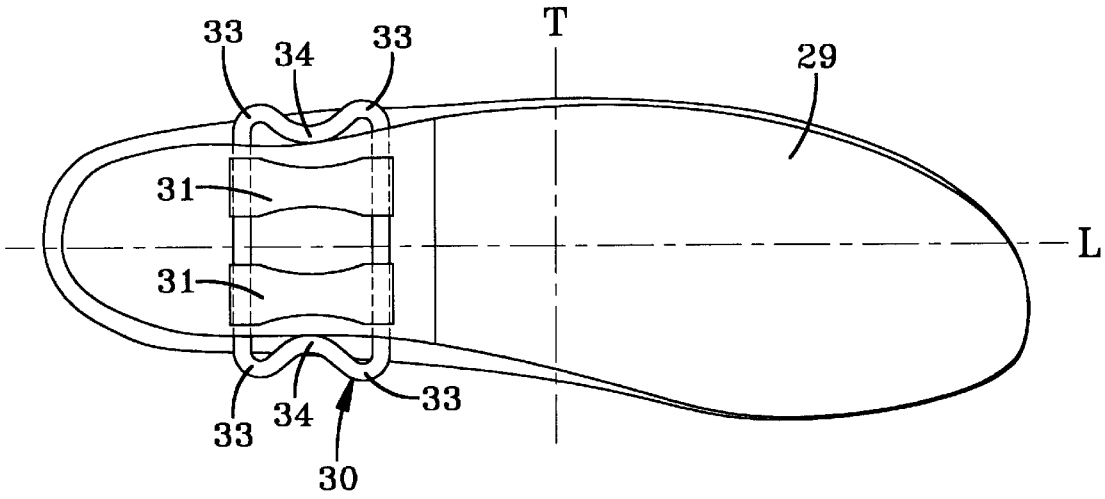
FIG. 3 is a plan view of the underside of the sole of a snowboard boot according to the present invention.
Figure 4:
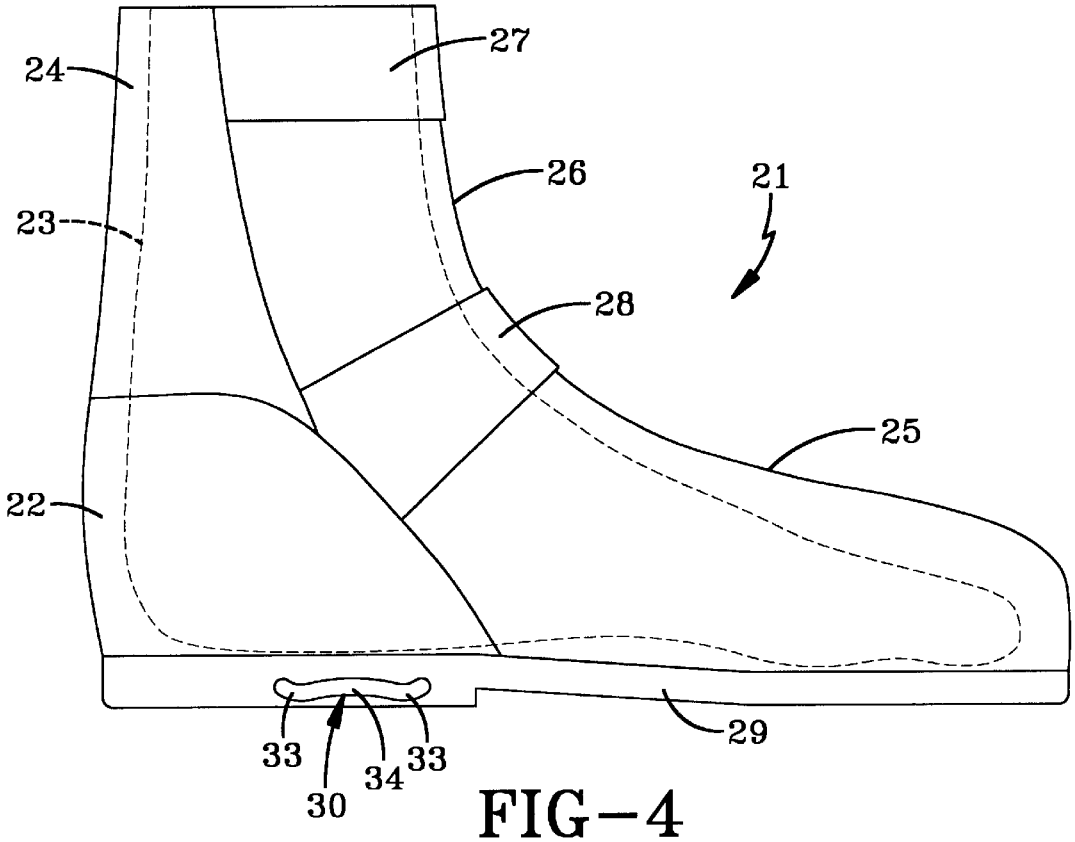
FIG. 4 is a side view of the snowboard boot.

In another preferred aspect of the present invention, a boot 21, illustrated in FIGS. 3 and 4, includes a shell part 22 which grips around the heel from the bottom, the sides and the rear. Boot 21 is designed as a rigid structural part, and the shell part may have a relatively rigid foot shell. However, in order to make it possible for the snowboarder to walk comfortably, it is advantageous if shell part 22 extends only in the region of the heel of a foot 23 or within a region which in normal shoes or boots is occupied by the heel.

A calf support 24 is secured on shell part 22, so as to be tiltable about a transverse axis. The capacity of calf support 24 for tilting in a rearward direction is restricted in that shell part 22 in calf support 24 interact in a stop-like manner as soon as calf support 24 reaches the position as shown in FIG. 4. Calf support 24 can only then be tilted in the forward direction relative to shell part 22.

Shell part 22 and calf support 24 are connected to a forefoot region 25 and a shaft 26 of boot 21. Both the forefoot 25 and shaft 26 are designed to be flexible to the greatest possible extent for the purposes of securing calf support 24 more firmly on the snowboarders' leg. It is possible to provide a strap 27, which is guided around the tibia of the snowboarders' leg. A strap 28, which is guided over the in-step of the foot 23, makes it possible for shell part 22 to be secured firmly on the heel.

In sole 29 of boot 21, the sole extends beneath shell part 22 and forefoot region 25. The sole includes both a longitudinal axis L, and a transverse axis, T. An adapter piece 30 is embeded in the region of shell part 22. The adapter piece being connected fixedly to shell part 22. The adapter piece comprises a stable wire frame, of which rectilinear transverse members are secured firmly on the underside of shell part 22 by way of link plates 31 and rivets or the like.

Longitudinal members of the wire frame of adapter piece 30 run along the sole borders having a double "S" shape, such that in each case two protrusions 33, which are spaced apart from one another in the longitudinal direction of the boot, and an indent 34 arranged therebetween are formed. Boot 21 interacts with the snowboard binding by way of protrusions 33 and indents 34 in the manner which will be discussed below.

Figure 5:
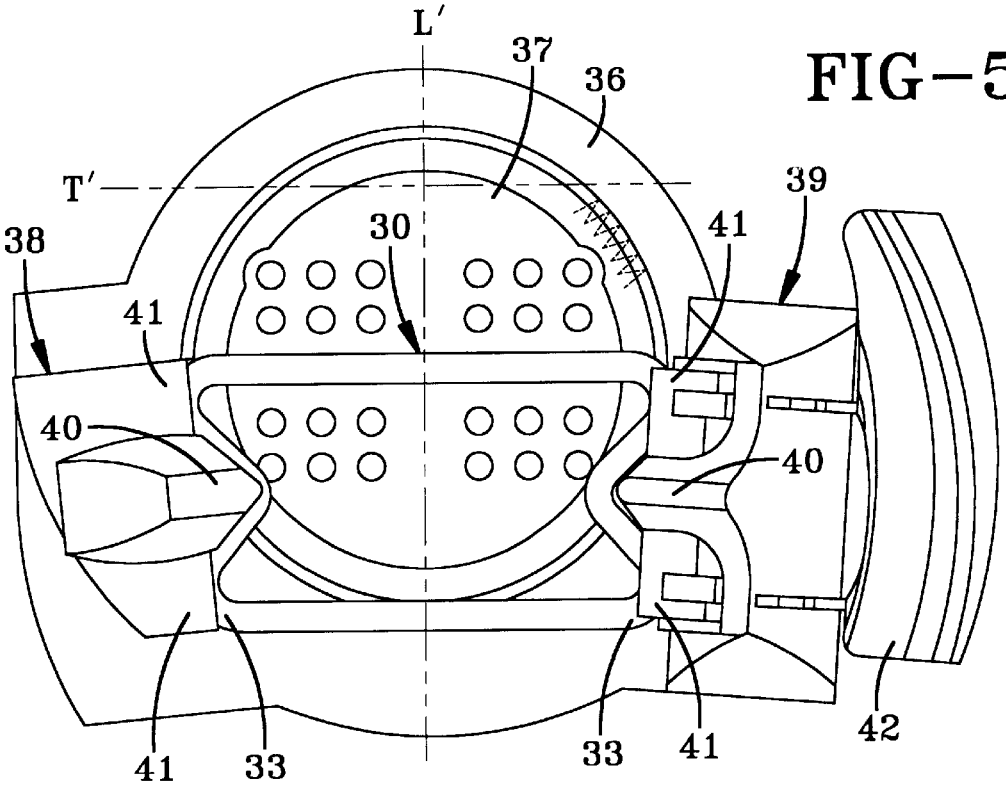
FIG. 5 is a plan view of a snowboard binding according to the present invention with a boot side adapter piece in which the mating locking parts and indents are formed being illustrated in addition.
Figure 6:
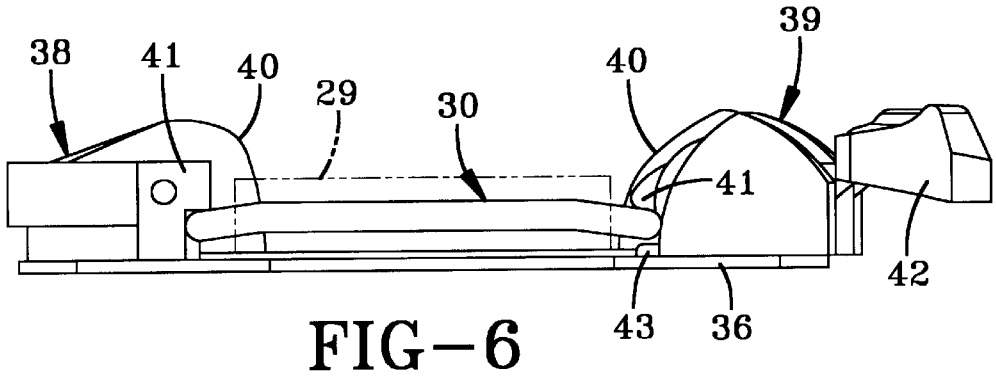
FIG. 6 is a side view of the binding in FIG. 5.
Figure 7:
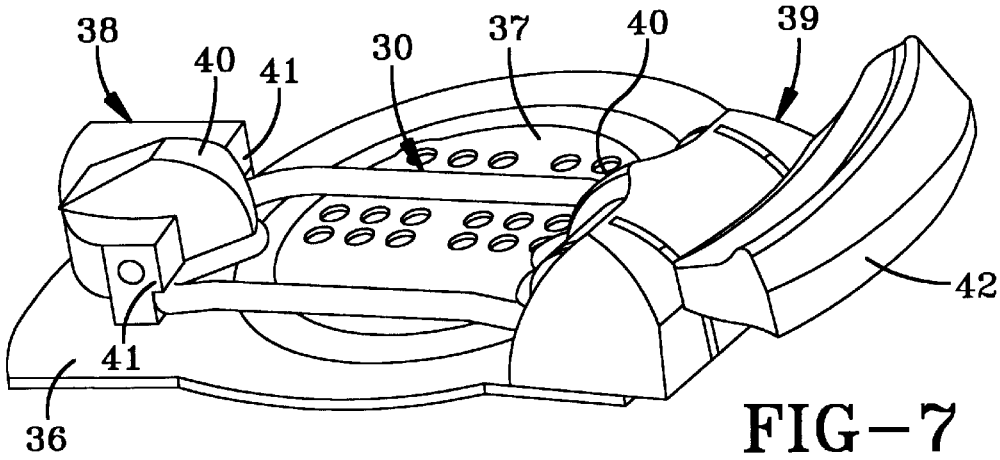
FIG. 7 is a perspective view of the binding shown in FIGS. 5 and 6.

The binding, as shown in FIGS. 5–7, has a standing plate 36, which is fastened on the top side of a snowboard (not shown). The binding includes a longitudinal axis L', and transverse axis T'. Standing plate 36 includes a large central circular opening, which can be covered by means of a flange plate 37, which also covers the borders of the circular opening. Flange plate 37 is screwed to the snowboard and thus clamps the standing plate 36 against the top side of the snowboard. Flange plate 37 is screw connected by means of a plurality of screws, such that the flange plate is secured on the snowboard in a non-rotatable manner. A radial toothing arrangement on the underside border region of the flange plate 37 engages in a mating radial toothing arrangement on the topside of the border region of central circular opening of standing plate 36. This results in that the standing plate 36 is secured in a frictionally locking manner on account of the bracing between flange plate 37 and the snowboard, and also in a positively locking manner on account of the toothing arrangements engaging with one another.

A stationary boot-retaining and locking unit 38 and a movable boot-retaining and locking unit 39 serve the purpose of securing a boot 23 positioned on standing plate 36. Units 38 and 39 interact with protruding portions 33 and indent portions 34 of adapter piece 30, and are arranged such that the central region between the ball of and heel of a foot is positioned over the center of flange plate 37, when respective boot 21 is introduced correctly into the binding. The result is that the adapter piece 30 is arranged on boot 21, so as to be offset in the longitudinal direction of the heel. The boot-retaining and locking units 38 and 39 are also arranged in a correspondingly offset manner on standing plate 36, such that a vertical plane passing through the boot-retaining and locking units 38 and 39 is at a relatively large distance from the center of the flange plate 37.

Boot-retaining and locking units 38 and 39 each have a protuberance-like nose 40 adapted to the shape of indents 34 of adapter piece 30 and continuations 41. Continuations 41 interact with protrusions 33 of adapter piece 30. In the locking position, protrusions 33 grip beneath continuation 41. At the same time, noses 40 engage in indents 34 in a positively locking manner, such that the adapter piece 30 is locked firmly on the snowboard in a non-moveable manner.

In order to remove the boot from the binding, moveable boot-retaining and locking unit 39 is displaced by means of a hand grip 42 from the locking position (shown in FIG. 6) into its released position where continuations 41, or the locking elements bearing continuations 41, assume a self-retained released position. When continuations 41 assume a self-retaining released position they have been pivoted in the clockwise direction, wherein adapter piece 30 and boot 21 can be lifted out of the binding.

When the boot is introduced into the binding, noses 38 and 39 interact with indents 34 of the adapter piece 30 in the manner of a guide, such that, when boot 21 is pressed down against the standing plate 36, boot 21 is guided with continuously decreasing play in the direction of the locking position. Introduction of boot 21 into the binding is facilitated in that, as seen in the view of FIG. 6, the mutually opposite sides of noses 40 of boot-retaining and locking units 38 and 39 are spaced apart from one another by a distance which increases as the distance from the standing plate 36 increases.

During introduction of the boot 21 into the binding, boot 21 is pressed down to a sufficient extent, guided by protrusions 33 of adapter piece 30, which are directed toward the moveable boot-retaining and locking unit 39, until boot 21 interacts with a tread spur 43, which then brings the boot-retaining and locking unit 39 into the locking position. The binding is thus designed in the manner of a step-in binding, i.e. at least one locking unit 39 has a self-retaining release position, in which the boot 21 can be raised out of the binding and from which, when the boot is introduced into the binding, locking unit 39 automatically transfers into the locking position.

Figure 8:
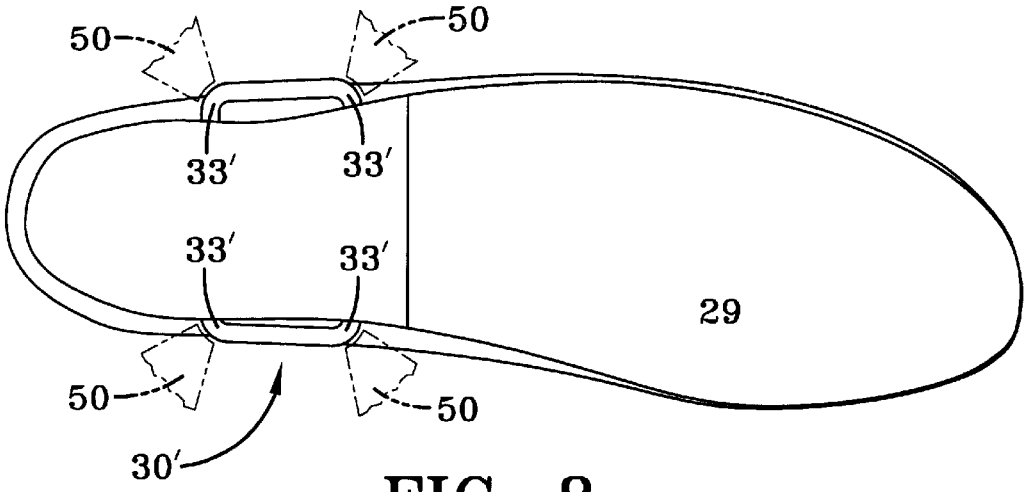
FIG. 8 is a modification of the embodiment shown in FIG. 3.

The embodiment which is illustrated in FIG. 8 differs from the embodiment of FIG. 1, inter alia, in that, on the longitudinal side of the boot, an adapter piece 30' has essentially rectilinear or slightly arcuate webs which extend essentially in the longitudinal direction of the boot and are angled in the transverse direction of the boot at a total of four corner regions 33'. In this case, adapter piece 30' may, once again, be formed by a stable wire frame, which can be connected to sole 29 and/or heel-side shell part 21 in the same way as in the exemplary embodiment of FIG. 3.

Corner regions 33' can interact with a set of four stoplike guides 50, at least when adapter piece 30' is locked in the snowboard binding, so that the adapter piece is centered and fixed in a positively locking manner in the longitudinal and transverse directions of the boot. For this purpose, guides 50 may grip around corner regions 33' in the longitudinal and transverse directions of the boot.

Moreover, guides 50 may be arranged, similar to the protuberance-like noses 40 (see, in particular, FIG. 6), as rib-like protrusions on the boot-retaining and locking units 38 and 39, and may preferably be arranged in a funnel-like manner, such that, as the boot advances toward the standing plate 36 of the binding or toward the top side of the snowboard, adapter piece 30' is gripped with decreasing play in a positively locking manner in the longitudinal and transverse directions of the boot.

Furthermore, corner regions 33' may interact, in the same way as the protrusions 33 in the example of FIG. 5, with binding-side continuations 41 and a tread spur 43 (see FIG. 6), by means of which adapter piece 30' can be fixed in the vertical direction, and moveable continuations 41 of the binding can be pressed into their locking position.

In the case of all the embodiments described above, it is possible, if appropriate, to dispense with boot-side calf support 24.

Figure 9:
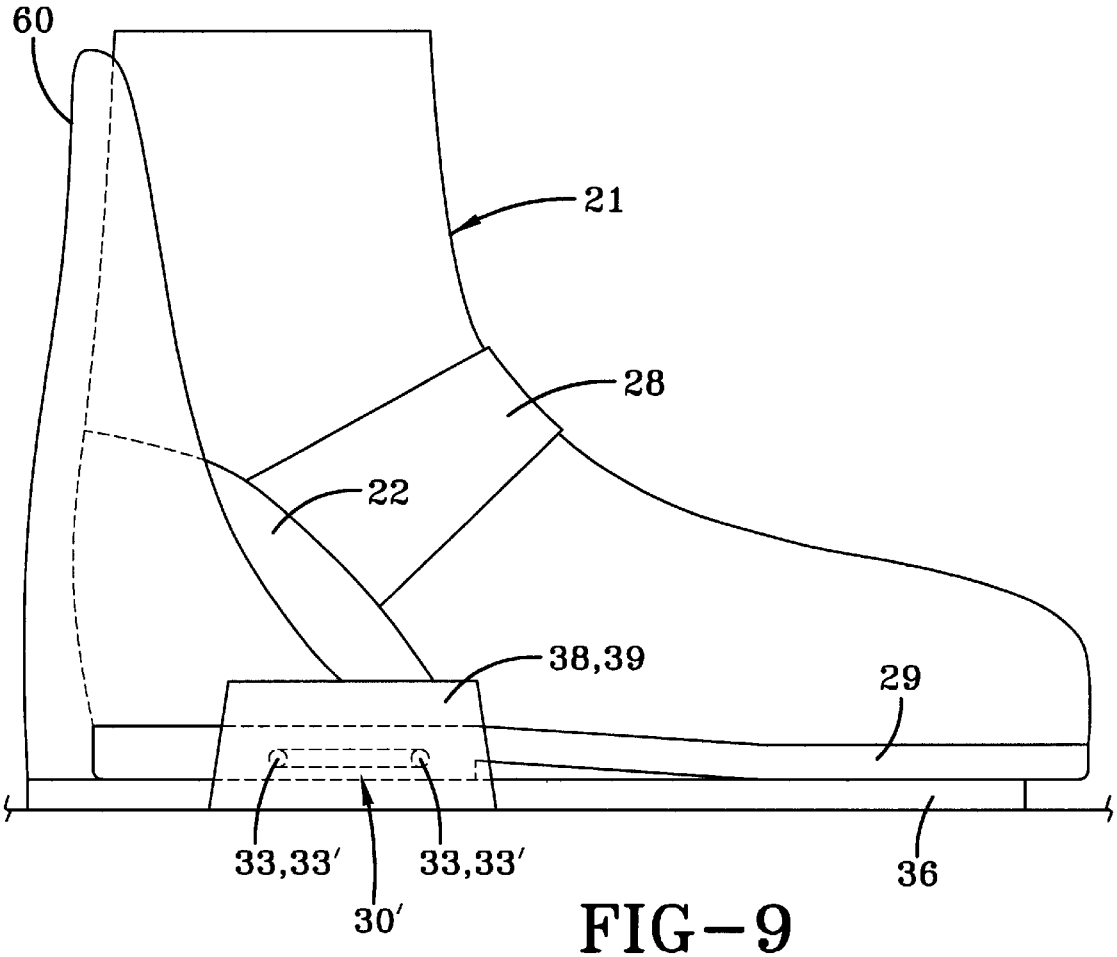
FIG. 9 is a side view of a binding with a boot introduced therein and with a binding side calf support.

If appropriate, it is also possible, according to FIG. 9, for a boot-side calf support to be replaced by a binding-side calf support 60, which may be designed so as to be tiltable, such that it can be tilted in a clockwise direction, so that the snowboard can be transported more easily.

Such a binding-side calf support 60 provides the advantage that boot 21 may also be of extremely flexible design in the rear shaft region and, in practice, need only have rigid heel-side shell part 22 as a relatively dimensionally stable structural part, since a firm and secure fit of shell part 22 on the foot can be afforded by a good, snug fit of boot 21 and by strap 28, which is guided over the instep, with the result that adapter piece 30', which is connected to shell part 22, is also firmly secured.

Furthermore, the binding-side calf support is advantageous insofar as it can be utilized as an additional guide for when boot 21 is introduced into the binding.

For this reason, the arrangement of the binding-side calf support 60, at least of a rudimentary or reduced design, may be expedient even when the boot 21 has a boot-side calf support 24.

In the case of all the embodiments outlined above, the front and rear protrusions 33 or corner regions 33' of adapter piece 30 or 30', as seen in the longitudinal direction of the boot, can be spaced apart by a longitudinal distance of approximately 50 mm. It being the case that front protrusions 33 or corner regions 33', as seen in the longitudinal direction of the boot, are located in the region of a vertical transverse boot plane which extends approximately centrally between the heel region and ball-of-the-foot region of the boot and/or more or less through the center of flange plate 37 or some other center about which standing plate 36 of the binding can be rotated on the snowboard.

It should be appreciated that the front and rear protrusions 33 or corner regions 33' of adapter piece 30 or 30' could form four corners of a trapezium or the four corners of a trapezoid or trapazeim. This shaped adapter piece could be used to interface with the protuberances or stop-like guides in a stopping manner when inserting the boot into the binding from a forward or rearward entry.

The foregoing description is a specific embodiment of the present invention. It should be appreciated that this embodiment is described for purposes of illustration only, and that numerous alterations and modifications may be practiced by those skilled in the art without departing from the spirit and scope of the invention. It is intended that all such modifications and alterations be included insofar as they come within the scope of the invention as claimed or the equivalents thereof.

Having described the invention, the following is claimed:

1. A binding and boot combination for snowboards, the boot including a sole having a heel, a toe and having a longitudinal and transverse axis, said snowboard binding having a standing surface and a longitudinal and transverse axis, said combination comprising:

a boot having a pair of locking members arranged on opposite sides of the longitudinal axis of said boot; and a snowboard binding having a pair of boot-retaining locking units arranged on opposite sides of the longitudinal axis of said binding, each of said boot retaining locking units comprising:

boot retaining apparatus for interacting in a positively locking manner with said locking members of said boot; and a guide apparatus for guiding the boot as it is received by said snowboard binding and as the boot advances vertically toward the standing surface to a final fixed position wherein said boot retaining apparatus enters a locked position and fixes the boot to the standing surface, said guide apparatus increasingly restricting the boot in the longitudinal and transverse directions as the boot advances vertically toward the standing surface.

2. The binding and boot combination for snowboards as defined in claim 1 wherein each of said locking members extend in the longitudinal direction of said boot and includes two protruding portions on opposite ends of each of said locking members, said boot retaining apparatus holding at least one of said protruding portions on each side of said boot in a locking manner when in a locked position.

3. The binding and boot combination for snowboards as defined in claim 2, wherein the protruding portions form corners of a trapezoid connected by parallel sides extending in the transverse direction.

4. The binding and boot combination for snowboards as defined in claim 3, wherein the corners of the trapezium, as seen in the longitudinal direction of the boot, are spaced apart from one another in the transverse direction of the boot by a greater distance than the other corners.

* * * * *